US010556726B2

(12) United States Patent
Ruthe-Steinsiek et al.

(10) Patent No.: US 10,556,726 B2
(45) Date of Patent: Feb. 11, 2020

(54) DEVICE FOR PRESSING OUT A MATERIAL FROM A DEFORMABLE TUBE

(71) Applicant: Henkel AG & Co. KGaA, Duesseldorf (DE)

(72) Inventors: Kai Ruthe-Steinsiek, Duesseldorf (DE); Peter Rushe, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 16/154,099

(22) Filed: Oct. 8, 2018

(65) Prior Publication Data

US 2019/0100356 A1 Apr. 4, 2019

Related U.S. Application Data

(63) Continuation of application No. PCT/EP2017/058680, filed on Apr. 11, 2017.

(30) Foreign Application Priority Data

Apr. 12, 2016 (DE) ..... 10 2016 206 084

(51) Int. Cl.
*B65D 35/28* (2006.01)
*B65B 69/00* (2006.01)
(Continued)

(52) U.S. Cl.
CPC ..... *B65D 35/28* (2013.01); *B05C 17/00583* (2013.01); *B65B 69/005* (2013.01);
(Continued)

(58) Field of Classification Search
CPC ..... B65D 35/28; B65D 35/56
See application file for complete search history.

(56) References Cited

U.S. PATENT DOCUMENTS 6,315,165 B1 * 11/2001 Regan ..... B65D 35/28 222/103
8,752,543 B2 * 6/2014 Davies ..... A61M 15/009 128/200.14

(Continued)

FOREIGN PATENT DOCUMENTS

| | | |
|---|---|---|
| CN | 203186657 U | 9/2013 |
| EP | 2490956 B1 | 8/2014 |
| WO | 0000405 A2 | 1/2000 |

OTHER PUBLICATIONS

International Search Report for International PCT Patent Application No. PCT/EP2017/058680 dated May 29, 2017.

*Primary Examiner* — Jeremy Carroll
(74) *Attorney, Agent, or Firm* — James E. Piotrowski

(57) ABSTRACT

The invention relates to a device for pressing out a material from a deformable tube, comprising the following: a housing having a base end; an upper section opposite the base end; and lateral wall sections between the base end and the upper section; a squeezer that can be introduced into the housing, wherein the squeezer has a carrier element and two opposing jaws for gripping and squeezing out a material from the tube, wherein the housing has an opening in the upper section through which an outlet of the tube can be guided, and same has openings in opposing parts of the lateral wall sections via which the jaws can be actuated, wherein the jaws are secured to the carrier element at one end and the squeezer also has a manual lever element on at least one jaw, wherein the lever element is connected to the jaw in a connection region to form an assembly, in which a pressure manually applied to the lever element brings about a force on the jaw in the direction of the other jaw, wherein the lever element has a body with reinforcing ribs, wherein the reinforcing ribs are surrounded at least partially by a
(Continued)

closed outer skin, wherein a region of the outer skin forms a gripping region.

10 Claims, 4 Drawing Sheets

(51) Int. Cl.
*B05C 17/005* (2006.01)
*B65D 35/56* (2006.01)
*B05B 11/04* (2006.01)

(52) U.S. Cl.
CPC ..... *B65D 35/56* (2013.01); *B05B 11/048* (2013.01); *B65D 2231/00* (2013.01)

(56) References Cited

U.S. PATENT DOCUMENTS

| | | | | |
|---|---|---|---|---|
| 8,794,858 | B2 * | 8/2014 | Kirk, III | B05B 11/048 222/103 |
| 2007/0218229 | A1 * | 9/2007 | Nagahama | B65D 35/28 428/35.7 |
| 2012/0248145 | A1 * | 10/2012 | Kealy | B65D 35/28 222/103 |
| 2017/0267413 | A1 * | 9/2017 | Qian | B65D 35/28 |

* cited by examiner

DEVICE FOR PRESSING OUT A MATERIAL FROM A DEFORMABLE TUBE

The present invention relates to a device for pressing a substance out of a deformable tube. The tube can consist of plastics material or metal, for example. The substance to be pressed out can be in particular an adhesive.

Devices of this kind for pressing a substance out of a deformable tube are intended to make it easier to handle the tube and to press out and apply the substance to a surface. In particular the dosing of the substance is intended to be made easier.

A device for pressing a substance out of a deformable tube is known from EP 24 90 956 B1, which device comprises a housing and a squeezer that can be inserted into the housing, the squeezer comprising a support element and two jaws positioned opposite one another for gripping and squeezing a substance out of the tube. Lever elements are attached to the jaws for manual operation of the squeezer.

It is an object of the present invention to disclose an improved device for pressing a substance out of a deformable tube. In particular, the handling of the device is to be improved to the effect that the substance can be precisely dosed and the tube emptied, even with a relatively low force exertion.

This object is achieved by the subject matter of the independent claim. Further embodiments are the subject matter of the dependent claims.

According to one embodiment of the invention, a device for pressing a substance out of a deformable tube is disclosed, which device comprises a housing having a base end, an upper portion opposite the base end and lateral wall portions between the base ends and the upper portion. The device further comprises a squeezer that can be inserted into the housing, the squeezer comprising a support element and two jaws positioned opposite one another for gripping and squeezing a substance out of the tube.

The housing further comprises an opening in the upper portion, through which a dispensing outlet of the tube can be guided, and openings in opposite sides of the lateral wall portions, by means of which the jaws can be operated, the jaws being secured at one end to the support element and the squeezer furthermore comprising a manual lever element on at least one jaw.

The lever element is connected to the jaw in a connection region in an arrangement in which pressure applied manually to the lever element produces a force on one jaw towards the other jaw. The lever element comprises a body that has reinforcing ribs, the reinforcing ribs being surrounded, at least in part, by a closed outer shell, one region of the outer shell forming a grip region.

According to this embodiment, a device is provided by means of which a user can squeeze a substance out of the deformable tube by exerting pressure, in the grip regions, on the manual lever elements. This pressure is transferred from the lever element to the jaws and from the jaws to the deformable tube.

The device is advantageous in that the lever element is particularly suitable for transferring a relatively low force to the deformable tube in a particularly effective manner. For this purpose, the lever element is not completely solid and therefore not completely stiff, but rather has a degree of flexibility on account of the reinforcing ribs, without losing load-bearing capacity. The reinforcing ribs are in this case not exposed in the grip region but are covered by a closed outer shell. This substantially improves the handling of the device, since rib-like structures exposed in the grip region can push into the fingers of the user when the device is being handled. This is at least uncomfortable but can even be painful, which negatively affects the handling of the device.

According to one embodiment of the invention, the lever element has a concave portion on the at least one jaw at the same height as the connection region. This has the object of further improving the handling of the device. Said portion creates a secure hold for the fingers of a user and prevents the fingers from slipping off in the event of pressure being exerted. Furthermore, the concave portion visually emphasizes the grip region.

Moreover, the lever element can be convex, for example.

According to one embodiment of the invention, the radius of curvature r of the outer shell of the lever element in the concave portion is 5 mm≤r≤50 mm, in particular 16 mm≤r≤35 mm. It has been demonstrated that a portion curved in such a way offers a particularly secure hold in the grip region.

According to one embodiment of the invention, grip ribs are arranged in the grip region on the outer shell of the lever element. The grip ribs can be formed for example as relatively small elevations of at most 1 mm on the outer shell and can be arranged in particular so as to be transverse to the longitudinal direction of the lever element. The object of the grip ribs is to prevent the fingers of a user from slipping off and thereby further improve the handling.

The grip ribs can be formed for example from the material of the outer shell and be integral therewith.

According to one embodiment of the invention, the connection region between the lever element and the jaw has a length L, L being less than 25% of the length of the jaw. Length measurement in this case is assumed to be in the longitudinal direction of the lever element or the jaw.

For example, L is 2 mm≤L≤20 mm, in particular 3 mm≤L≤12 mm.

It has been demonstrated that the connection between the lever element and the jaw, in the case of said dimensions, is robust and stable enough to reliably transfer a force exerted by the user on the lever element to the jaws. However, the connection is relatively flexible and therefore makes it easier to handle the device.

It is furthermore advantageous for the connection region between the lever element and the jaw to have a maximum width v, which is at most half of the width b of the jaw in said region. For example, v can be at most 7 mm.

Furthermore, it is additionally advantageous for the connection region between the lever element and the jaw to be arranged substantially in the third quarter of the jaw as seen from the support element. Therefore, in one embodiment of the device, the connection region is arranged in an upper half of the jaw, remote from the support element, but not in the region of the uppermost 20% of the jaw.

This arrangement allows an optimal lever action to be achieved. The connection region channels the force exerted by a user and distributes it over the entire length of the jaw. If the connection region is arranged too close to the opening in the housing and therefore too close to an outlet of the tube, problems can arise with respect to handling because the tube is not sufficiently flexible in the immediate vicinity of its outlet. Complete emptying of the tube can also be problematic.

If in turn the connection region is arranged so as to be too far removed from the opening in the housing and therefore from the outlet of the tube, the leverage exerted on the jaw is significantly lower and it is no longer possible to handle the device with low forces.

According to one embodiment, the body of the lever element is integral with the jaws. This is advantageous in that the lever element and the jaws can be particularly flexible and simultaneously stable.

According to one embodiment, the housing is open at the base end thereof and the squeezer can be inserted into the housing through the open end thereof and fixed therein. A secure connection between the housing and the squeezer can be achieved in this way.

Embodiments of the invention are described in more detail below with reference to the drawings, in which:

BRIEF DESCRIPTION OF THE DRAWINGS

FIG. 1 shows an empty housing 1 of a device for pressing a substance out of a deformable tube according to one embodiment of the invention. The housing 1 comprises an open base end 2 and an upper portion 3 opposite the base end 2, and lateral wall portions 4 that form the housing 1 between the base end 2 and the upper portion 3. A squeezer (not shown in FIG. 1) having a tube can be inserted through the open base end 2. A dispensing outlet of the tube can be guided through an opening 5 in the upper portion 3.

Figure 1:
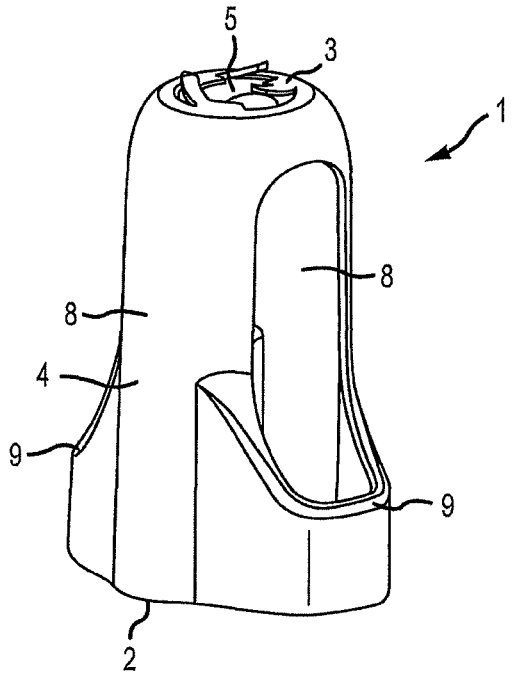
FIG. 1 is a schematic perspective view of a housing of a device according to one embodiment of the invention.

The housing 1 further comprises one opening 8 in each of the two opposite sides, in the lateral wall portions 4 of said housing. Below the openings 8, the lateral wall portions 4 project outwardly and form shoulders 9, such that the open base end does not have a round cross section but rather likewise comprises projections.

Figure 2:
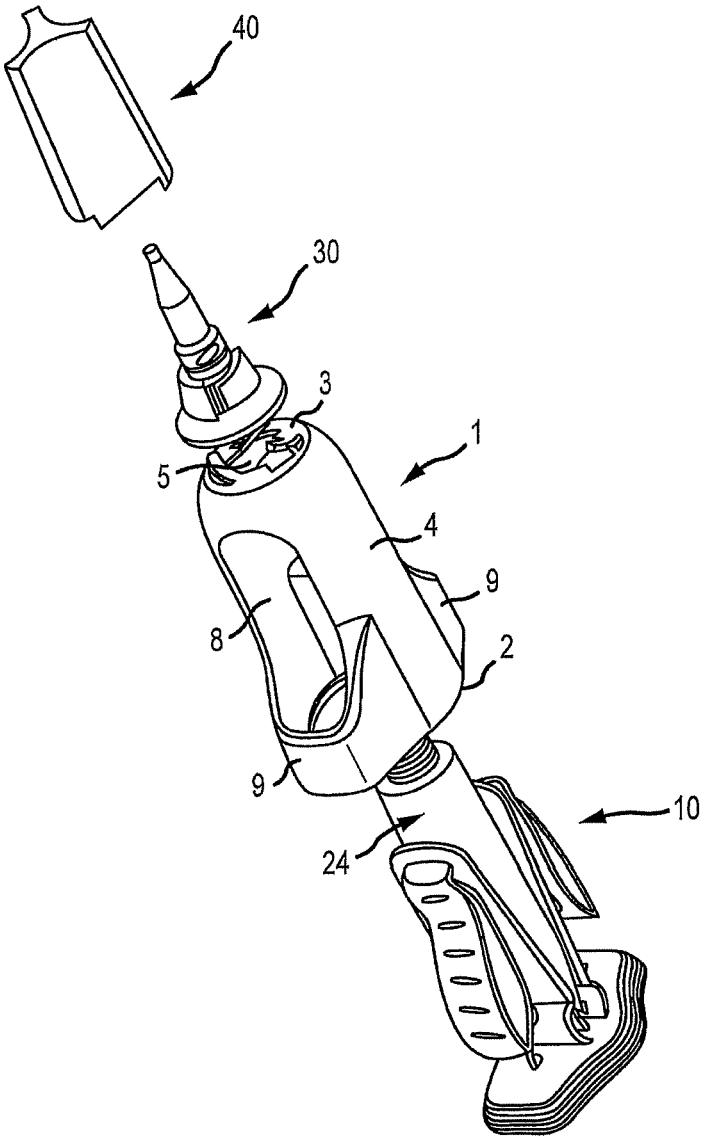
FIG. 2 is a schematic exploded view of a device for pressing a substance out of a deformable tube according to one embodiment of the invention.

FIG. 2 shows the entire device for pressing a substance out of a deformable tube, having the housing 1 according to FIG. 1, a squeezer 10 that can be inserted into the housing 1 and has a tube 24, an application nozzle 30 that can be placed on the housing 1 and a closure cap 40 that can be placed on the application nozzle 30.

Figure 3A:
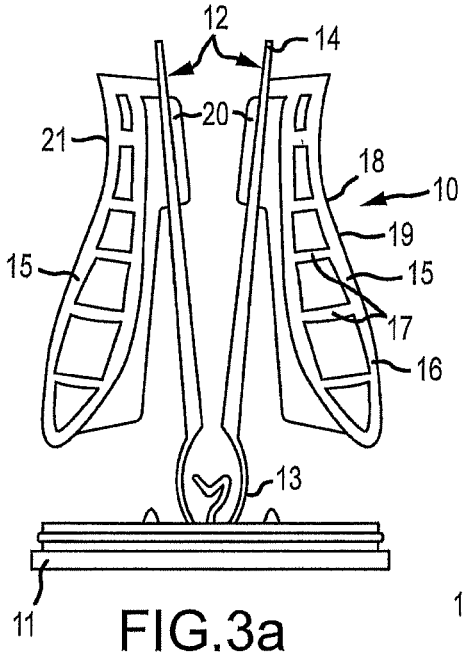
FIGS. 3*a*, 3*b* and 3*c* are schematic side views of a squeezer according to one embodiment of the invention in the first or resting position, second or intermediate position and third position respectively.
Figure 3B:
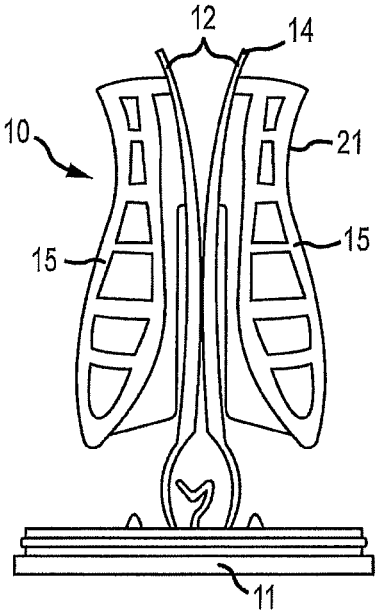
Figure 3C:
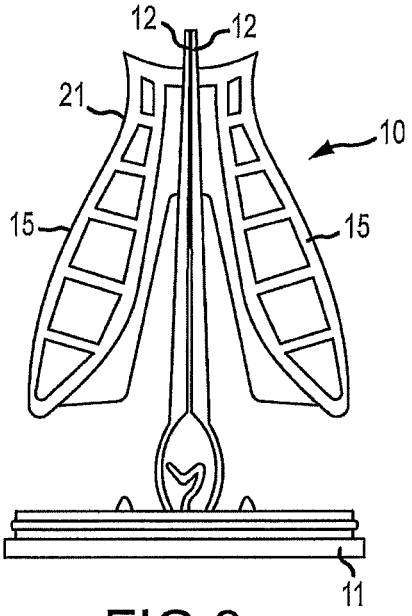
Figure 4:
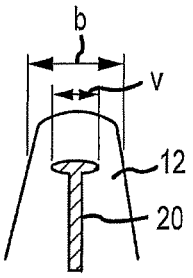
FIG. 4 is a schematic partially cross-sectional view of a connection region of the squeezer according to FIG. 3.
Figure 5:
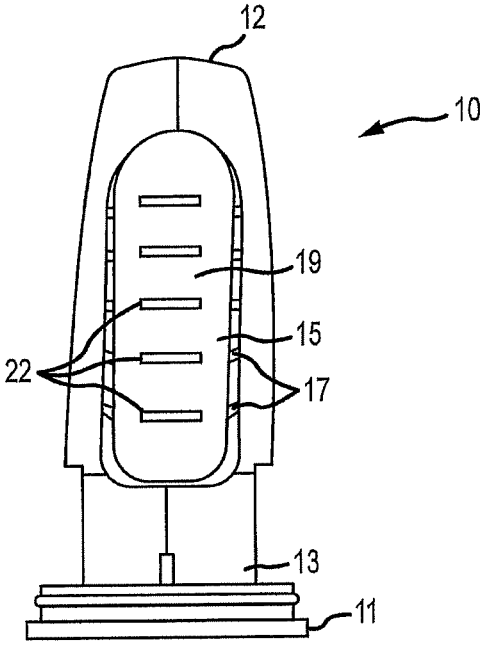
FIG. 5 is a schematic side view of a squeezer according to one embodiment of the invention that can be inserted into the housing according to FIG. 1.

The squeezer 10, which is shown in detail in FIGS. 3 to 5, is guided, together with the tube 24 inserted therein, through the open base end 2 of the housing 1, such that a dispensing outlet of the tube 24 is guided through the opening 5 and lever elements (shown in more detail in FIGS. 3 to 5) of the squeezer 10 are exposed in the openings 8, or protrude outwardly through the openings 8.

FIGS. 3 to 5 show a cross section, or side view, of the squeezer 10. The squeezer 10 comprises two jaws 12, positioned opposite one another, that interact in the manner of pliers and are connected at the lower end 13 thereof to a support element 11. When the squeezer 10 is inserted into the housing 1, the support element 11 forms a bottom of the housing 1.

In a resting state, the jaws 12 diverge from one another at the upper end 14 thereof. This is shown in FIG. 3*a*. A tube, for example an adhesive tube, can be arranged between the jaws 12, such that the jaws 12 abut the outer tube wall.

Each jaw 12 comprises a lever element 15 that can be manually operated, i.e. by a user and by hand. Each lever element 15 is connected to the jaw 12 in a connection region 20. Said element can be produced for example as an injection-molded part so as to be integral with the jaw 12. The connection region 20 extends in the longitudinal direction of the jaw 12, or of the lever element 15, and, in the embodiment shown, is arranged substantially in the third quarter of the jaw 12 as seen from the support element 11, that is to say, in the upper half of the jaw 12, remote from the support element 11, but not in the region of the uppermost 20% of the jaw 12. A very effective lever action is achieved as a result, which allows the tube to be squeezed very precisely and with relatively low force exertion, simultaneously allowing residue to be emptied effectively from the tube. The force required to squeeze the tube is typically in the range between 18 and 28 N, in particular between 20 and 25 N.

Furthermore, the connection region 20 merely extends at most over a quarter of the length of the jaws 12, such that the jaws 12 remain flexible. High flexibility of the jaws 12 is also achieved by the connection region 20 having a maximum extent in the transverse direction of half the width of the jaws 12. In the embodiment shown, the connection region 20 is 6.8 mm wide at the widest point thereof.

The lever element 15 comprises a body 16 having reinforcing ribs 17. Said ribs cause the lever element 15 to be sufficiently stable despite its non-solid formation. Solid formation of the lever element 15 would lead to a lack of flexibility and thus to more difficult handling of the device. The reinforcing ribs 17 can be formed transversely to the longitudinal direction of the lever element 15, as shown in FIGS. 3*a* to 3*c*. However, they can also extend in a different direction and/or reinforcing ribs 17 that extend in a plurality of directions or curved reinforcing ribs 17 can be provided.

The reinforcing ribs 17 are not exposed at the surface of the lever element 15 at least in a grip region 19 of the lever element 15, but instead are surrounded, or covered, by an outer shell 18. A user of the device therefore does not come into contact with exposed reinforcing ribs 17 when using the device in the intended way. The outer shell 18 can surround the lever element 15 completely or only in specific regions. In the embodiment shown, the reinforcing ribs 17 (as can be seen in FIG. 4) are laterally exposed by the grip region 19 and not encased in said region by the outer shell 18.

The lever element 15 has a concave portion 21 at the same height as the connection region 20, in which portion the grip region 19 is formed concavely in order to offer a better fingerhold.

The functioning of the squeezer when a tube (not shown in the drawings for sake of clarity) is squeezed is explained with reference to FIGS. 3*a* to 3*c*.

FIG. 3*a* shows the squeezer 10 in a first position, also referred to as a resting position, in which no force is exerted on the lever elements 15. The jaws 12 are opened wide.

FIG. 3*b* shows the squeezer 10 in a second position, which represents an intermediate position and which is assumed when a degree of force is exerted on the lever elements 15 and thus on the jaws 12 by a user pushing together the lever elements 15 using their fingers. In said intermediate position, the jaws 12 still significantly diverge from one another at the upper end 14 thereof, yet are already in contact with one another in the lower third. It can be seen here that the jaws 12 are not simply pushed together by the exertion of force on the lever elements 15, but rather in each case are bent in on themselves. In particular, the arrangement and design of the connection region 20 allows the jaws 12 to bend and as a result allows particularly effective emptying of the tube from below.

FIG. 3*c* shows the squeezer 10 in a third position, in which the jaws 12 are fully in contact with one another and which is assumed when, proceeding from FIG. 3*b*, force is further exerted on the lever elements 15.

FIGS. 3*a* to 3*c* show the squeezer 10 without a tube inserted therein. When a tube is arranged between the jaws 12, the jaws 12 can no longer contact one another. Instead of contact, close convergence then occurs with a firmly squeezed tube arranged therebetween.

FIG. 4 shows the connection region 20 between the jaw 12 and the lever element 15 (not shown in this view). It can be seen here that the connection region 20 has a maximum width v in the region of the upper end thereof. In this case, v is at most half of the width b of the jaw 12 in said region.

FIG. 5 is a side view of the squeezer 10. Grip ribs 22 can be seen therein, which are arranged in the grip region 19 on the outer shell 18 and which are intended to prevent the fingers of the user from slipping off. The grip ribs 22 can for example be designed as moldings on the outer shell 18 itself.

LIST OF REFERENCE SIGNS

1 housing
2 base end
3 upper portion
4 lateral wall portion
5 opening
8 opening
9 shoulders
10 squeezer
11 support element
12 jaw
13 first end
14 second end
15 lever element
16 body
17 reinforcing ribs
18 outer shell
19 grip region
20 connection region
21 concave portion
22 grip ribs
24 tube
30 application nozzle
40 closure cap

The invention claimed is:

1. A device for pressing a substance out of a deformable tube, the device comprising:

a housing having a base end, an upper portion opposite the base end, and lateral wall portions between the base end and the upper portion, a squeezer configured to be inserted into the housing, the squeezer comprising a support element and two jaws positioned opposite one another for gripping and squeezing the substance out of the tube, wherein the housing comprises an opening in the upper portion through which a dispensing outlet of the tube can be guided, and openings in opposite sides of the lateral wall portions, by which the jaws can be operated, the jaws being secured at one end to the support element and the squeezer further comprising a manual lever on at least one jaw, the lever being connected to the jaw in a connection region in an arrangement in which pressure applied manually to the lever produces a force on one jaw towards the other jaw, the lever comprises a non-solid body that has reinforcing ribs, the reinforcing ribs being surrounded, at least in part, by a closed outer shell, one region of the outer shell forming a grip region.

2. The device according to claim 1, wherein the lever element has a concave portion on the at least one jaw at the same height as the connection region.

3. The device according to claim 2, wherein the radius of curvature r of the outer shell of the lever element in the concave portion is 5 mm≤r≤50 mm.

4. The device according to claim 1, wherein grip ribs in the grip region are arranged on the outer shell of the lever element.

5. The device according to claim 1, wherein the connection region between the lever element and the jaw has a length L, L being less than 25% of the length of the jaw.

6. The device according to claim 5, wherein the length L is in the range of 2 mm to 20 mm.

7. The device according to claim 6, wherein the connection region between the lever element and the jaw has a maximum width v, which is at most half of a width b of the jaw in the connection region.

8. The device according to claim 1, wherein the connection region between the lever element and the jaw is arranged in an upper half of the jaw, remote from the support element, but not in the region of the uppermost 20% of the jaw.

9. The device according to claim 1, wherein the body of the lever element is integral with the jaws.

10. The device according to claim 1, wherein the housing is open at the base end thereof and the squeezer can be inserted into the housing through the open base end and fixed therein.

* * * * *